US005943951A

United States Patent [19]

Muellner et al.

[11] Patent Number: 5,943,951

[45] Date of Patent: Aug. 31, 1999

[54] PRESS ROLL FOR TREATING A MATERIAL SHAPED IN THE FORM OF A WEB

[75] Inventors: Josef Muellner, Heidenheim; Uwe Matuschczyk, Geislinger, both of Germany

[73] Assignee: Voith Sulzer Papiermaschinen GmbH, Heidenheim, Germany

[21] Appl. No.: 08/991,435

[22] Filed: Dec. 16, 1997

[30] Foreign Application Priority Data

Dec. 17, 1996 [DE] Germany ..... 196 52 545

[51] Int. Cl.[6] ..... D21F 3/02; B30B 3/00

[52] U.S. Cl. ..... 100/37; 100/118; 100/153; 100/155 R; 162/205; 162/358.4; 162/901; 198/847; 492/7; 492/20; 492/27; 492/48; 492/50

[58] Field of Search ..... 100/37, 118, 151, 100/153, 155 R; 162/205, 358.2, 358.3, 358.4, 901; 198/847; 492/4, 7, 20, 27, 48, 50, 51, 56, 59

[56] References Cited

U.S. PATENT DOCUMENTS

| | | | |
|---|---|---|---|
| 2,651,256 | 9/1953 | Huck | 492/50 |
| 3,710,470 | 1/1973 | Krake | 492/48 |
| 4,330,023 | 5/1982 | Cronin | 100/153 |
| 5,342,277 | 8/1994 | Steiner et al. | 492/56 |
| 5,766,421 | 6/1998 | Aufrecht | 162/901 |

FOREIGN PATENT DOCUMENTS

| | | |
|---|---|---|
| 3607941 | 5/1989 | Germany . |
| 4401580 | 6/1994 | Germany . |
| 4443598 | 6/1996 | Germany . |
| 4445472 | 6/1996 | Germany . |
| 2199398 | 7/1988 | United Kingdom . |

*Primary Examiner*—Stephen F. Gerrity
*Attorney, Agent, or Firm*—Greenblum & Bernstein, P.L.C.

[57] ABSTRACT

Flexible press sleeve for a press roll for treating a web includes an inside surface including a longitudinal press area adapted to be pressurized with a press shoe by directing pressure radially outward, and a flexible section on at least one end of the press area having a greater flexibility than a flexibility of the press sleeve outside the flexible section, without causing a significant weakening of the press sleeve within the flexible section. A press shoe includes the press roll and a mating roll forming a press opening with the press roll. A method of treating a web includes draining a fibrous pulp web by using the press shoe.

21 Claims, 1 Drawing Sheet

PRESS ROLL FOR TREATING A MATERIAL SHAPED IN THE FORM OF A WEB

CROSS-REFERENCE OF RELATED APPLICATION

The present invention claims the priority under 35 U.S.C. §119 of German Patent Application No. 196 52 545.4 filed on Dec. 17, 1996, the disclosure of which is expressly incorporated by reference herein in its entirety.

BACKGROUND OF THE INVENTION

1. Field of the Invention

The present invention relates to a press roll for treating material shaped in the form of a web, in particular to drain a fibrous pulp web, with a flexible press sleeve which has an inside that, in order to determine the longitudinal press area, can be pressurized with a press shoe by directing pressure radially outward. The invention furthermore relates to a press shoe for treating material shaped in the form of a web with a press roll and a mating object, in particular a mating roll, that creates a press opening with the press roll.

2. Discussion of Background Information

The flexible press sleeve of a rotating press roll of the type mentioned at the outset is typically pressed radially against a mating object, for example a rotating mating roll, with the aid of a press shoe positioned radially inside the press roll, whereby the friction occurring between the press shoe and the interior surface of the press roll is reduced by an oil film provided between these two elements. The fibrous pulp web to be drained is guided through the press opening created between the press roll and the mating roll and drained by the pressure present in the press opening.

A problem of conventional devices is that the press sleeve of a press shoe in operation is not only stressed by the surface pressure in the press opening but is also dynamically stressed by a changing bending strain. The areas of the press sleeve located on both ends of the press shoe are most affected by this dynamic bending strain. The curvature in this section of the press sleeve changes from convex to concave or vice versa, depending on whether the press sleeve, relative to its horizontal center position, is bent outward by the press shoe, or pressed radially inward by the mating roll. This constantly repeating curvature change represents high mechanical strains to these press sleeve sections and leads to increased crack formations across the press sleeve.

SUMMARY OF THE INVENTION

An object of the present invention is to construct a press sleeve and a press shoe of the type mentioned at the outset so that the danger of crack formation in the press sleeve due to dynamic straining in the press shoe end sections is avoided or at least reduced.

This task is accomplished for a press sleeve of the type mentioned at the outset, wherein the press sleeve has a flexible section on at least one end of the press area with a greater flexibility than the flexibility in the area of the press sleeve outside the flexible section, without causing a significant weakening of the press sleeve within the flexible section.

By providing a special flexible section with an increased flexibility on one end of the press section area or on both ends of the press area, it is ensured that the curvature changes occurring due to dynamic strain do not lead to crack formations in this flexible section of the press sleeve. In accordance with the invention, the flexible section must be constructed such that no significant weakening of the press sleeve occurs, since otherwise the risk reduction with respect to crack formations, achieved by increasing the flexibility, would be offset. A weakening of the press sleeve in the press shoe end sections could, for example, result in crack formations in the press sleeve caused by the tensile loads attacking these sections during operation so that, in effect, the danger of crack formations would even be increased.

In a preferred embodiment of the invention, the flexible section extends from an area within the press area to an area outside the press area. This ensures that the flexible section having the required flexibility and at the same time the required stiffness is placed at the location of the press sleeve that undergoes the heaviest strain due to dynamic loading. The heavily-strained area of the press sleeve extends into the press area, in particular when the width of the fibrous pulp web to be treated is smaller than the width of the press shoe and therefore the width of the press area is determined by the press shoe, so that the required flexibility of the press sleeve also must be ensured in the end sections. The flexible section can thereby be arranged symmetrically or asymmetrically around the edge of the press area.

In another embodiment of the invention, the press sleeve has a smaller thickness in the area of the flexible section than the press area portion located outside the flexible section. The press sleeve thickness thereby decreases radially outward. The reduced press sleeve thickness produces the desired press sleeve flexibility, whereby the thickness is only reduced as far as being able to maintain the required stability of the press sleeve. The continuous reduction of press sleeve thickness, in particular radially outward, ensures that the flexibility of the press sleeve increases axially outward from the edge zones of the press area to obtain the desired flexibility in the section of the press sleeve that undergoes the heaviest strain. A continuous reduction thereby ensures that no stability failures occur in the axial direction of the press sleeve.

In another preferred embodiment of the invention, the press sleeve within the flexible section comprises, at least sectionally, a material with higher flexibility than outside the flexible section, in particular an elastomeric material. The material used can be adjusted optimally to the operating requirements by using different materials inside and outside the flexible section of the press sleeve. The material for the edge zones of the press area and for the adjoining area of the press sleeve must have a relatively high flexibility and at the same time a high tensile strength, while the press sleeve material inside the press area is to be optimized to the high press forces occurring in the press opening.

In accordance with the present invention, a flexible press sleeve for a press roll for treating a web includes an inside surface including a longitudinal press area adapted to be pressurized with a press shoe by directing pressure radially outward. The flexible press sleeve also includes a flexible section on at least one end of the press area having a greater flexibility than a flexibility of the press sleeve outside the flexible section, without causing a significant weakening of the press sleeve within the flexible section.

In a further embodiment, the flexible section extends from an area within the press area to an area outside the press area.

In a further embodiment, the press sleeve in an area of the flexible section has a smaller thickness than in an area of the press area located outside the flexible section.

In a still further embodiment, the thickness of the flexible section is continuously reduced toward an outside.

In a still further embodiment, the press sleeve has an outer surface which drops off within the flexible section toward an end of the press sleeve.

In a still further embodiment, the outer surface of the press sleeve forms an oblique surface.

In a still further embodiment, the oblique surface may extend at an angle $\alpha$ of about $\leqq 3°$ to the outer surface of the press sleeve located outside the flexible section. Further, the oblique surface may extend at an angle $\alpha$ of about $\leqq 2°$ to the outer surface of the press sleeve located outside the flexible section. Still further, the oblique surface may extend at an angle $\alpha$ of about $\leqq 1°$ to the outer surface of the press sleeve located outside the flexible section.

In a further embodiment, at least a portion of the press sleeve within the flexible section includes a material having higher flexibility than a material of the press sleeve outside the flexible section.

In a still further embodiment, the material having higher flexibility comprises a soft, elastomeric material.

In a further embodiment, the flexible section may have an axial width of at least about 20 mm. Further, the flexible section may have an axial width of at least about 30 mm. Still further, the flexible section may have an axial width of at least at least about 50 mm.

In a further embodiment, the flexible section may overlap the press area by at least about 10 mm. Further, the flexible section may overlap the press area by at least about 20 mm. Still further, the flexible section may overlap the press area by at least about 30 mm.

In accordance with another embodiment of the present invention, a press for treating a web, includes a press roll including a press shoe and a flexible press sleeve. The press sleeve has an inside surface including a longitudinal press area adapted to be pressurized with the press shoe by directing pressure radially outward, and the press sleeve further including a flexible section on at least one end of the press area having a greater flexibility than a flexibility of the press sleeve outside the flexible section, without causing a significant weakening of the press sleeve within the flexible section. The press shoe also includes a mating roll forming a press opening with the press roll.

In accordance with yet another embodiment of the present invention, a flexible press sleeve for a press roll for treating a web includes a longitudinal press area and a flexible section on at least one end of the press area having a greater flexibility than a flexibility of the press sleeve outside the flexible section, without causing a significant weakening of the press sleeve within the flexible section.

The present invention also involves a method of treating a web including draining a fibrous pulp web by using a press. The press includes a press roll including a press shoe and a flexible press sleeve. The press sleeve having an inside surface including a longitudinal press area adapted to be pressurized with the press shoe by directing pressure radially outward, and the press sleeve further including a flexible section on at least one end of the press area having a greater flexibility than a flexibility of the press sleeve outside the flexible section, without causing a significant weakening of the press sleeve within the flexible section. The press shoe also includes a mating roll forming a press opening with the press roll.

Further embodiments and advantages can be seen from the detailed description of the present invention and the accompanying figures.

BRIEF DESCRIPTION OF THE DRAWINGS

The present invention is further described in the detailed description which follows, in reference to the noted drawings by way of non-limiting examples of preferred embodiments of the present invention, wherein same reference numerals represent similar parts throughout the several views of the drawings.

DETAILED DESCRIPTION

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
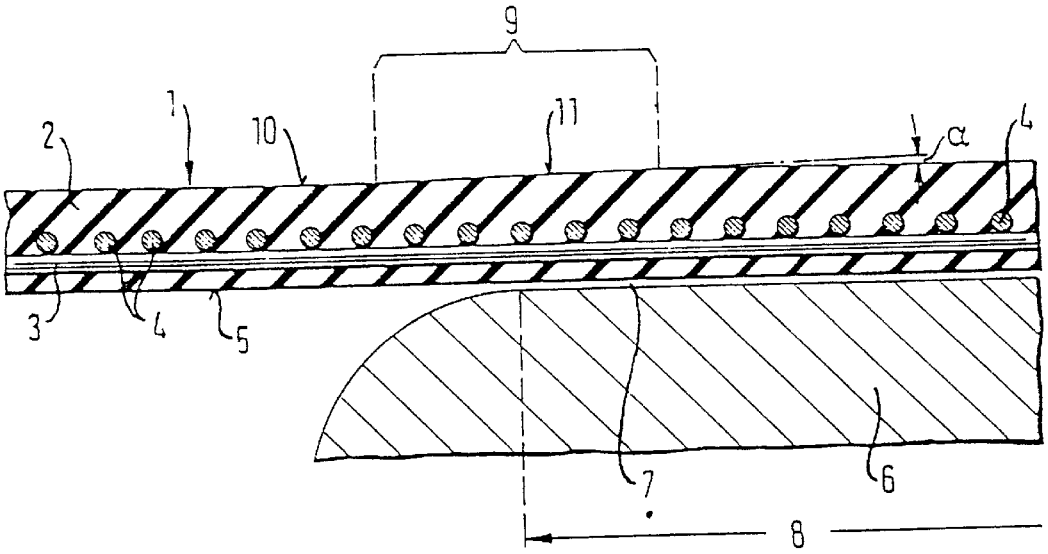
FIG. 1 is a cross section through a portion of a first embodiment of a press roll constructed in accordance with the invention.

FIG. 1 displays a portion of a press sleeve 1 comprising an elastomeric matrix 2 containing longitudinal and cross threads 3, 4.

The press sleeve 1 makes contact with a portion of its inside surface 5 on the outer surface of a press shoe 6. The press sleeve 1 is preferably made of polyurethane. A lubricant 7, for example in the form of oil, is provided between the inside surface 5 of the press sleeve 1 and the press shoe 6 in order to enable the press sleeve 1 to glide on the press shoe 6 in a relatively frictionless manner.

The press shoe 6 is pressed axially outward against the inside surface 5 of the press sleeve 1 by pressure units that are not illustrated, so that the contact surface defines a press area 8 of the press sleeve 1.

The press sleeve 1 contains a flexible section 9 in which the outer surface 10 of the press sleeve 1 extends at an angle $\alpha$ with respect to the outer surface 10 of the press sleeve 1 located outside the flexible section 9. The outer surface 10 thereby creates an oblique surface 11 inside the flexible section 9 and extends over the entire circumference of the press sleeve 1. In a press sleeve 1 mounted parallel to the longitudinal axis of the press roll, the oblique surface 11 is therefore sloped at the angle $\alpha$ with respect to the longitudinal axis.

The thickness of the press sleeve 1 decreases along the oblique surface 11 in the direction of the press sleeve edge, so that the flexibility of the press sleeve 1 in flexible section 9 and beyond, up to the press sleeve end, is higher than inside the press area 8. The oblique surface 11 gradually joins the portion of the press sleeve 1 located outside the flexible section 9, so that no discontinuities are created on the outer surface of the press sleeve 1 that reduce the stability of the press sleeve 1.

Due to the low degree of inclination of the oblique surface 11, the reduction of the thickness of press sleeve 1 is so small that a weakening of the press sleeve 1 as a result of reducing the thickness practically does not occur.

The oblique surface 11 extends at an angle $\alpha$ of about $\leqq 3°$, preferably $\alpha$ about $\leqq 2°$, and more preferably $\alpha$ about $\leqq 1°$ to the outer surface 10 of the press sleeve 1 located outside the flexible section 9. The axial width of the flexible section 9 measures at least about 20 mm, preferably at least about 30 mm, and more preferably at least about 50 mm. The flexible section 9 overlaps the press area 8 by at least about 10 mm, preferably at least about 20 mm, and may overlap by at least about 30 mm or even at least about 40 mm. In other words, the flexible section 9 extends over the press area 8 by at least about 10 mm, preferably at least about 20 mm, and may extend over each other by at least about 30 mm or even at least about 40 mm.

Figure 2:
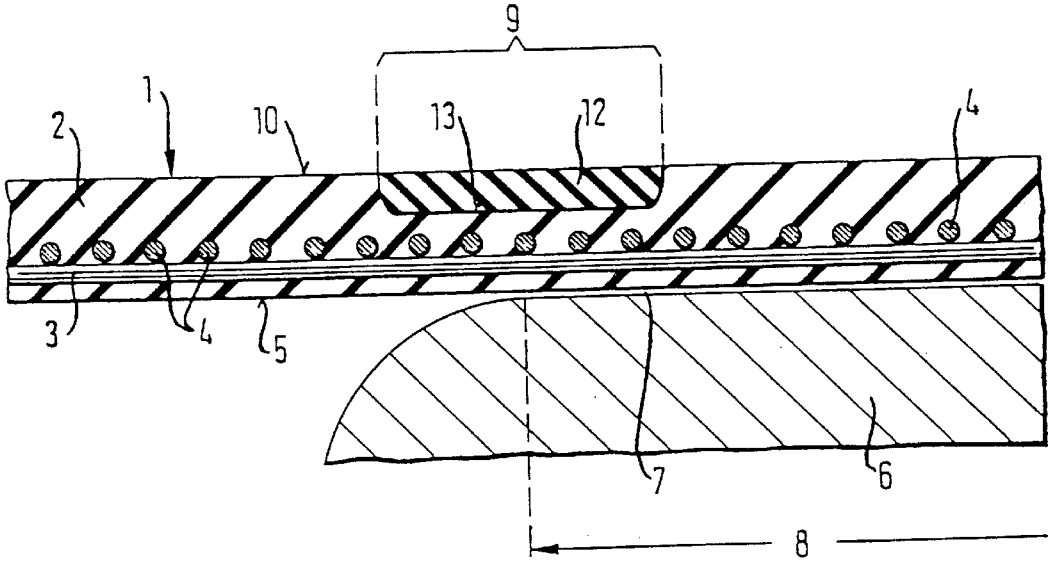
FIG. 2 is a cross section through a portion of a second embodiment of a press roll constructed in accordance with the invention.

FIG. 2 shows an embodiment wherein an elastomeric element 12, having a higher degree of flexibility than that of the elastomeric matrix 2, is used inside the flexible section 9 of the press sleeve 1. The elastomeric element is preferably made of softer polyurethane. The illustrated embodiment shows a recess 13 located on the outer surface 10 of the press sleeve 1. The recess 13 extends in a ring-shaped manner over the circumference of the press sleeve 1 and is used to insert the elastomeric element 12. The elastomeric element can be connected with the elastomeric matrix 2 with the aid of conventional methods, such as gluing, vulcanizing, etc.

It is furthermore possible to arrange the elastomeric element 12 not in a ring-shaped manner, but in individual sections along the circumference of the press sleeve 1.

In principle it is also possible to insert the elastomeric element 12 into the inner surface 5 of the press sleeve instead of the outer surface 10 of the press sleeve, or that the elastomeric element 12 extends over the entire thickness of the press sleeve 1.

While the illustrated embodiments form the outer surface 10 of the press sleeve in a smooth manner, it is also possible to form holes, grooves or other types of recesses in the outer surface 10 in order to improve the drainage of the fibrous pulp web to be treated.

It is also possible to combine the embodiment illustrated in FIG. 1 with the embodiment illustrated in FIG. 2, i.e., to increase the flexibility by reducing the press sleeve thickness as well as using a softer elastomeric material inside the flexible section 9.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and the spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed:

1. A flexible press sleeve for a press roll for treating a web, comprising:

an inside surface including a longitudinal press area adapted to be pressurized with a press shoe by directing pressure radially outward;

a flexible section on at least one end of the press area having a greater flexibility than a flexibility of the press sleeve outside the flexible section, without causing a significant weakening of the press sleeve within the flexible section;

the press sleeve, in an area of the flexible section, having a smaller thickness than in an area of the press area located outside the flexible section; and the thickness of the flexible section being reduced toward an outside.

2. The press sleeve of claim 1, the flexible section extending from an area within the press area to an area outside the press area.

3. The press sleeve of claim 1, the thickness of the flexible section being continuously reduced toward the outside.

4. The press sleeve of claim 1, the press sleeve having an outer surface which drops off within the flexible section toward an end of the press sleeve.

5. The press sleeve of claim 4, the outer surface of the press sleeve forming an oblique surface.

6. The press sleeve of claim 5, the oblique surface extending at an angle $\alpha$ of about $\leqq 3°$ to the outer surface of the press sleeve located outside the flexible section.

7. The press sleeve of claim 5, the oblique surface extending at an angle $\alpha$ of about $\leqq 2°$ to the outer surface of the press sleeve located outside the flexible section.

8. The press sleeve of claim 5, the oblique surface extending at an angle $\alpha$ of about $\leqq 1°$ to the outer surface of the press sleeve located outside the flexible section.

9. The press sleeve of claim 1, at least a portion of the press sleeve within the flexible section comprising of a material having higher flexibility than a material of the press sleeve outside the flexible section.

10. The press sleeve of claim 9, the material having higher flexibility comprising a soft, elastomeric material.

11. The press sleeve of claim 1, the flexible section having an axial width of at least about 20 mm.

12. The press sleeve of claim 1, the flexible section having an axial width of at least about 30 mm.

13. The press sleeve of claim 1, the flexible section having an axial width of at least about 50 mm.

14. The press sleeve of claim 1, the flexible section overlapping the press area by at least about 10 mm.

15. The press sleeve of claim 1, the flexible section overlapping the press area by at least about 20 mm.

16. The press sleeve of claim 1, the flexible section overlapping the press area by at least about 30 mm.

17. The press sleeve of claim 1, the flexible section overlapping the press area by at least about 40 mm.

18. A press for treating a web, comprising:

a press roll comprising a press shoe and a flexible press sleeve;

the press sleeve having an inside surface including a longitudinal press area adapted to be pressurized with the press shoe by directing pressure radially outward;

the press sleeve further comprising a flexible section on at least one end of the press area having a greater flexibility than a flexibility of the press sleeve outside the flexible section, without causing a significant weakening of the press sleeve within the flexible section, the flexible section having a decreasing thickness toward an outside of the press area; and a mating roll forming a press opening with the press roll.

19. A flexible press sleeve for a press roll for treating a web, comprising:

a longitudinal press area; and a flexible section on at least one end of the press area having a greater flexibility than a flexibility of the press sleeve outside the flexible section, without causing a significant weakening of the press sleeve within the flexible section, the flexible section having a decreasing thickness toward an outside of the press area.

20. A method of treating a web, comprising:

draining a fibrous pulp web by using a press, the press including:

a press roll comprising a press shoe and a flexible press sleeve;

the press sleeve having an inside surface including a longitudinal press area adapted to be pressurized with the press shoe by directing pressure radially outward;

the press sleeve further comprising a flexible section on at least one end of the press area having a greater flexibility than a flexibility of the press sleeve outside the flexible section, without causing a significant weakening of the press sleeve within the flexible section, the flexible section having a decreasing thickness toward an outside of the press area; and a mating roll forming a press opening with the press roll.

21. A flexible press sleeve for a press roll for treating a web, comprising:

an inside surface including a longitudinal press area adapted to be pressurized with a press shoe by directing pressure radially outward;

a flexible section on at least one end of the press area having a greater flexibility than a flexibility of the press sleeve outside the flexible section, without causing a significant weakening of the press sleeve within the flexible section; and at least a portion of the press sleeve within the flexible section being composed of a material having higher flexibility than a material of the press sleeve outside tile flexible section.

* * * * *